United States Patent [19]

Mostosi

[11] Patent Number: 4,866,403

[45] Date of Patent: Sep. 12, 1989

[54] STATIONARY CONTACT FOR LOW-VOLTAGE CIRCUIT BREAKERS

[75] Inventor: Angelo Mostosi, Bergamo, Italy

[73] Assignee: SACE S.p.A. Costruzioni Elettromeccaniche, Bergamo, Italy

[21] Appl. No.: 131,799

[22] Filed: Dec. 11, 1987

[30] Foreign Application Priority Data

Dec. 11, 1986 [IT] Italy ..... 23992/86[U]

[51] Int. Cl.[4] ..... H01H 9/30

[52] U.S. Cl. ..... 335/201; 200/144 R

[58] Field of Search ..... 200/144 R, 147 R, 275; 335/196, 6, 26, 35, 201, 16

[56] References Cited

U.S. PATENT DOCUMENTS

| | | | |
|---|---|---|---|
| 4,086,460 | 4/1978 | Gillette | 200/147 R |
| 4,409,444 | 10/1983 | Yoshiyasu et al. | 200/144 R |
| 4,618,748 | 10/1986 | Mueller | 200/144 R |

*Primary Examiner*—E. A. Goldberg
*Assistant Examiner*—Lincoln Donovan
*Attorney, Agent, or Firm*—Diller, Ramik & Wight

[57] ABSTRACT

The present invention relates to a stationary contact for a low-voltage circuit breaker constituted by a contact holder element having a shaped slot and by a contact element fastened to the contact holder nearby the slot in order to generally improve the features of a low-voltage circuit breaker.

20 Claims, 2 Drawing Sheets

Fig.1
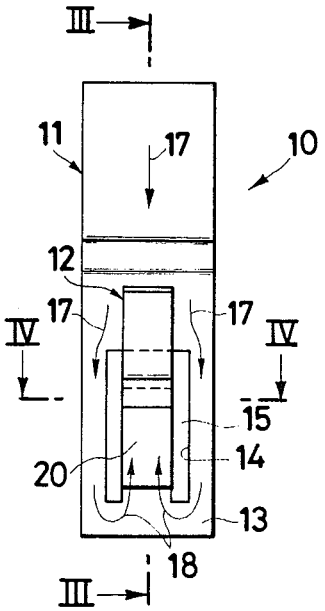
Fig.3
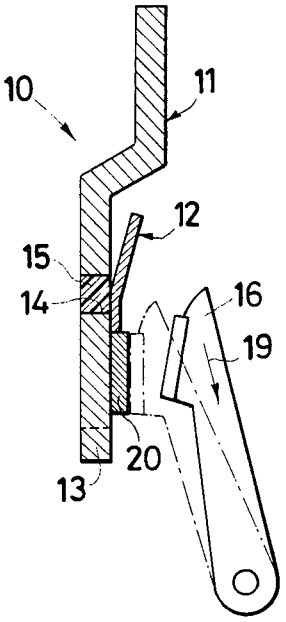
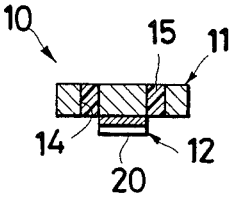
Fig.4
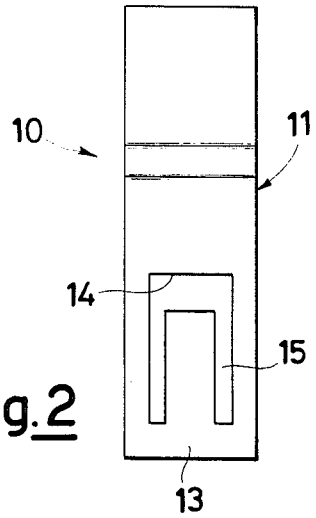
Fig.2

STATIONARY CONTACT FOR LOW-VOLTAGE CIRCUIT BREAKERS

The object of the present invention is a stationary contact for low-voltage circuit breakers.

Stationary contacts for low-voltage circuit breakers of the type provided with a hollow into which a contact-holder arm extends, are known e.g., from U.S. Pat. No. 4,513,267.

Such contact types are generally used in limiting switchgears which operate on the basis of the principle of the electrodynamic repulsion, for the opening of the contacts in case of a short-circuit.

The above-cited contacts cannot be used in case of circuit breakers wherein the opening of the contacts by electrodynamic repulsion is not desired, but on the contrary a force is necessary, after the opening of the contacts and the consequent triggering of an electrical arc, which pushes said arc as rapidly as possible towards the arc-quenching chamber.

The purpose of the present invention is to obviate the above cited drawbacks of the prior art by providing a stationary contact which is constituted by a contact-holder element and by a contact element, characterized in that said contact-holder element is a laminar element centrally provided, in the nearby of its lower end, with a through slot having a reverse-"U"-shape, and in that said contact element is fastened onto said contact-holder element in the nearby of the ends of the arms of said reverse-"U"-shapedthrough slot, said arms being directed towards the lower end of said contact-holder element.

Still according to the invention, the contact element is constituted by an electrically conductive shaped blade, which has a width smaller than the distance between the arms of the slot, extending upwards beyond said slot, and coming off from said contact-holder element.

In order to better understand the characteristics and further advantages of the present invention, said invention is now disclosed by referring to the hereto attached drawing table, wherein:

FIG. 1 shows a front view of a stationary contact according to the invention,

FIG. 2 shows a rear view of the stationary contact of FIG. 1,

FIG. 3 shows a sectional view according to path III—III of FIG. 1, wherein also a movable contact is schematically shown, FIG. 4 shows a sectional view according to path IV—IV of FIG. 1.

Figure 5:
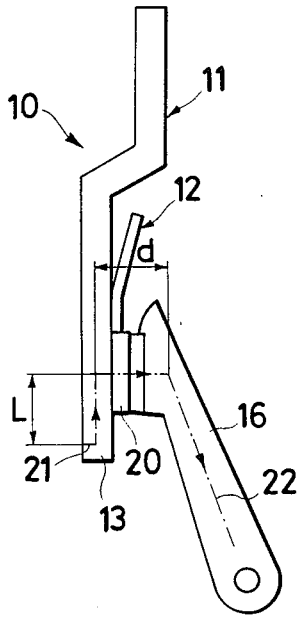
FIG. 5 is a diagram showing the theroretical current lines in the stationary contact of FIG. 1, and in a schematically shown movable contact.

Referring to the Figures, by the reference numeral 10 a stationary contact is generally indicated, which is constituted by a contact holder element 11, and by a contact 12 fastened onto it.

The contact holder element 11, of laminar shape, is provided, in the nearby of its lower end 13, with a "U"-shaped through slot 14, whose arms are directed towards said lower end 13. Furthermore, the through slot 14 results to be filled with an insulating material, indicated by the reference numeral 15.

The contact element 12, fastened in the nearby of the ends of the arms of said "U"-shaped hollow 14, is constituted by a shaped, electrically conductive blade, whose width is smaller than the distance between the arms of the slot 14.

Still according to the invention, the contact element 12 extends upwards beyond said slot, coming off from the contact-holder element 11.

When a movable contact 16 is closed on the stationary contact element 12, the electrical current will flow according to the direction shown by the arrows 17 and 18, and on the movable contact 16 it will flow according to the path shown by the arrow 19.

In practice, the current is obliged, on element 12, to bypass the obstacle created by the slot 14 filled with insulating material, to come to flow through a contact plate 20, provided in the lower portion of the element 12, flowing in a direction contrary to the direction according to which it will flow on the movable contact 16.

Nevertheless, due to the lengths, purposely reduced to the minimum, of the lengths run along by the electrical current on the element 12 and on the movable contact 16, the effect of electrodynamic repulsion (in case of short-circuit currents) must be considered practicaly negligible, or zero.

The paths along which the electrical current flows are schematically indicated in FIG. 5, wherein with "L" the length is schematically shown which is covered by the electrical current along a theoretical current line 21; and with "d", the distance between the line 21 and the middle line 22 of the movable contact 16 is indicated.

In practice, in order to render negligible or zero, as desired, the effect of electrodynamic repulsion (in case of short-circuit currents), it is important that the L/d ratio is as low as possible, anyway always lower than 1.

It should be observed that such a type of contacts is purposely realized for circuit breakers which are actuated to open by means of overcurrent tripping devices. When the contacts open, between them the electrical arc is generated, and at this time a force (of magnetic nature) suitable to push it as rapidly as possible towards the arc-quenching chamber is necessary.

Due to its intrinsic characteristics, the electrical arc will tend to move upwards the upper portion of the element 12 (in as much as it is colder), thus increasing in length, and hence undergoing a larger force, necessary to shift it rapidly into the arc-quenching chamber, without that any phenomena of electrodynamic repulsion, having such an extent as to cause the contacts to open, may occur.

I claim:

1. A stationary contact comprising a contact holder element having first and second opposite end portions, a generally U-shaped through slot in said second end portion, said U-shaped through slot being defined by a pair of generally parallel spaced slot arms and a slot bight between said slot arms, said slot arms projecting in a direction away from said first end portion, said second end portion being defined in part by a pair of lateral side portions and a leg portion between and spaced from said lateral side portions, said leg portion being directed toward said first end portion and in part defining said slot arms and slot bight, and a contact element carried by said leg portion.

2. The stationary contact as defined in claim 1 wherein the width of said contact element corresponds generally to the minimum distance between said slot arms.

3. The stationary contact as defined in claim 1 wherein said contact element includes a blade portion projecting beyond said leg portion across said slot bight toward said first end portion.

4. The stationary contact as defined in claim 1 wherein said contact element includes a blade portion projecting beyond said leg portion across said slot bight toward said first end portion, and a part of said blade portion overlies a part of said first end portion and defines an acute angle therewith.

5. The stationary contact as defined in claim 1 wherein said contact holder element and contact element each have an essentially rectangular plan.

6. The stationary contact as defined in claim 1 wherein said U-shaped through slot is filled with an electrically insulating material.

7. The stationary contact as defined in claim 1 including in combination therewith a movable contact carrying a contact element adapted to move between closed and open positions respectively in contact with and out of contact with said first-mentioned contact element, said lateral side portions each defining a current flow path along a current line having a length (L) corresponding generally to the distance between a centerline through said contact elements wherein the closed position thereof and a lateral current flow path spaced from the ends of said slot arms, a distance (d) being set-off between said current line and a centerline lengthwise through said movable contact, and the L/d ratio is less than 1.

8. The stationary contact as defined in claim 2 wherein said contact element includes a blade portion projecting beyond said leg portion across said slot bight toward said first end portion.

9. The stationary contact as defined in claim 2 wherein said contact element includes a blade portion projecting beyond said leg portion across said slot bight toward said first end portion, and a part of said blade portion overlies a part of said first end portion and defines an acute angle therewith.

10. The stationary contact as defined in claim 2 wherein said contact holder element and contact element each have an essentially rectangular plan.

11. The stationary contact as defined in claim 2 wherein said U-shaped through slot is filled with an electrically insulating material.

12. The stationary contact as defined in claim 2 including in combination therewith a movable contact carrying a contact element adapted to move between closed and open positions respectively in contact with and out of contact with said first-mentioned contact element, said lateral side portions each defining a current flow path along a current line having a length (L) corresponding generally to the distance between a centerline through said contact elements wherein the closed position thereof and a lateral current flow path spaced from the ends of said slot arms, a distance (d) being set-off between said current line and a centerline lengthwise through said movable contact, and the L/d ratio is less than 1.

13. The stationary contact as defined in claim 3 wherein said contact holder element and contact element each have an essentially rectangular plan.

14. The stationary contact as defined in claim 3 wherein said U-shaped through slot is filled with an electrically insulating material.

15. The stationary contact as defined in claim 3 including in combination therewith a movable contact carrying a contact element adapted to move between closed and open positions respectively in contact with and out of contact with said first-mentioned contact element, said lateral side portions each defining a current flow path along a current line having a length (L) corresponding generally to the distance between a centerline through said contact elements wherein the closed position thereof and a lateral current flow path spaced from the ends of said slot arms, a distance (d) being set-off between said current line and a centerline lengthwise through said movable contact, and the L/d ratio is less than 1.

16. The stationary contact as defined in claim 4 wherein said U-shaped through slot is filled with an electrically insulating material.

17. The stationary contact as defined in claim 4 including in combination therewith a movable contact carrying a contact element adapted to move between closed and open positions respectively in contact with and out of contact with said first-mentioned contact element, said lateral side portions each defining a current flow path along a current line having a length (L) corresponding generally to the distance between a centerline through said contact elements wherein the closed position thereof and a lateral current flow path spaced from the ends of said slot arms, a distance (d) being set-off between said current line and a centerline lengthwise through said movable contact, and the L/d ratio is less than 1.

18. The stationary contact as defined in claim 14 including in combination therewith a movable contact carrying a contact element adapted to move between closed and open positions respectively in contact with and out of contact with said first-mentioned contact element, said lateral side portions each defining a current flow path along a current line having a length (L) corresponding generally to the distance between a centerline through said contact elements wherein the closed position thereof and a lateral current flow path spaced from the ends of said slot arms, a distance (d) being set-off between said current line and a centerline lengthwise through said movable contact, and the L/d ratio is less than 1.

19. The stationary contact as defined in claim 18 wherein the width of said contact element corresponds generally to the minimum distance between said slot arms.

20. The stationary contact as defined in claim 19 wherein said contact holder element and contact element each have an essentially rectangular plan.

* * * * *